US008643682B2

(12) United States Patent
Kim et al.

(10) Patent No.: US 8,643,682 B2
(45) Date of Patent: Feb. 4, 2014

(54) METHOD FOR DRIVING A LIGHT SOURCE, LIGHT SOURCE APPARATUS FOR PERFORMING THE METHOD AND DISPLAY APPARATUS HAVING THE LIGHT SOURCE APPARATUS

(75) Inventors: Hyuk-Hwan Kim, Asan-si (KR); Dae-Gwang Jang, Incheon (KR); Hyung-Ku Kang, Seoul (KR); Hyeon-Yong Jang, Osan-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 683 days.

(21) Appl. No.: 12/640,505

(22) Filed: Dec. 17, 2009

(65) Prior Publication Data

US 2010/0188435 A1 Jul. 29, 2010

(30) Foreign Application Priority Data

Jan. 28, 2009 (KR) ..... 10-2009-0006452

(51) Int. Cl.
*G09G 5/10* (2006.01)

(52) U.S. Cl.
USPC ..... 345/690

(58) Field of Classification Search
None
See application file for complete search history.

(56) References Cited

U.S. PATENT DOCUMENTS

| | | | | |
|---|---|---|---|---|
| 2005/0184952 | A1 * | 8/2005 | Konno et al. | 345/102 |
| 2007/0002000 | A1 * | 1/2007 | Kwon | 345/102 |
| 2008/0224977 | A1 * | 9/2008 | Park et al. | 345/89 |
| 2008/0297463 | A1 * | 12/2008 | Tsuru et al. | 345/102 |

FOREIGN PATENT DOCUMENTS

| | | |
|---|---|---|
| KR | 1020050047357 | 5/2005 |
| KR | 1020070117847 | 12/2007 |
| KR | 1020080092581 | 10/2008 |

* cited by examiner

*Primary Examiner* — Christopher R Lamb
(74) *Attorney, Agent, or Firm* — F. Chau & Associates, LLC

(57) ABSTRACT

A method of driving a light source includes: determining a location of pixel data of a display relative to a plurality of light-emitting blocks of a light source, obtaining a plurality of luminance values of the light-emitting blocks corresponding to the location by using a lookup table (LUT) storing the luminance values of the light-emitting blocks, generating a plurality of histograms corresponding to the light-emitting blocks, determining a plurality of target luminance values of the light-emitting blocks using the histograms, and driving the light-emitting blocks using the determined target luminance values. The luminance values of the light-emitting blocks are based on the location of the pixel data within an image block of the display corresponding to each light-emitting block. Each of the histograms indicates a frequency of each of the luminance values of a respective one of the light-emitting blocks.

20 Claims, 7 Drawing Sheets

| | 1st BLOCK | 2nd BLOCK | | 7th BLOCK | 8th BLOCK |
|---|---|---|---|---|---|
| 1st → | 1010001010 | 0101010101 | ····· | 1100101011 | 0111001011 |
| 2nd → | 0011011000 | 0001000101 | ····· | 0111000010 | 1000001000 |
| ⋮ | ⋮ | ⋮ | ⋮ | ⋮ | ⋮ |
| 134th → | 1010001010 | 0101010101 | ····· | 1100101011 | 0111001011 |
| 135th → | 0011011000 | 0001000101 | ····· | 0111000010 | 1000001000 |

FIG. 8

| | 1st BLOCK | 2nd BLOCK | | 8th BLOCK | 9th BLOCK |
|---|---|---|---|---|---|
| 1st → | 1010001010 | 0101010101 | ····· | 1100101011 | 0111001011 |
| 2nd → | 0011011000 | 0001000101 | ····· | 0111000010 | 1000001000 |
| | ⋮ | ⋮ | | ⋮ | ⋮ |
| → | 1010001010 | 0101010101 | ····· | 1100101011 | 0111001011 |
| (135X120) th → | 0011011000 | 0001000101 | ····· | 0111000010 | 1000001000 |

FIG. 9

| | | | | | | | |
|---|---|---|---|---|---|---|---|
| B1 | B2 | B3 | B4 | B5 | B6 | B7 | B8 |
| B9 | B10 | B11 | B12 | B13 | B14 | B15 | B16 |
| B17 | B18 | B19 | B20 | B21 | B22 | B23 | B24 |
| B25 | B26 | B27 | B28 | B29 | B30 | B31 | B32 |
| B33 | B34 | B35 | B36 | B37 | B38 | B39 | B40 |
| B41 | B42 | B43 | B44 | B45 | B46 | B47 | B38 |
| B39 | B50 | B51 | B52 | B53 | B54 | B55 | B56 |
| B57 | B58 | B59 | B60 | B61 | B62 | B63 | B64 |

METHOD FOR DRIVING A LIGHT SOURCE, LIGHT SOURCE APPARATUS FOR PERFORMING THE METHOD AND DISPLAY APPARATUS HAVING THE LIGHT SOURCE APPARATUS

CROSS REFERENCE TO RELATED APPLICATIONS

This application claims priority under 35 U.S.C. §119 to Korean Patent Application No. 2009-6452, filed on Jan. 28, 2009 in the Korean Intellectual Property Office (KIPO), the disclosure of which is incorporated by reference in its entirety herein.

BACKGROUND OF THE INVENTION

1. Technical Field

Exemplary embodiments of the present invention relate to a method for driving a light source, a light source apparatus for performing the method, and a display apparatus having the light source apparatus.

2. Discussion of Related Art

A liquid crystal display (LCD) apparatus includes an LCD panel displaying an image using the light transmittance of liquid crystal molecules and a backlight assembly disposed under the LCD panel to provide the LCD panel with light.

The LCD panel includes an array substrate, a color filter substrate and a liquid crystal layer. The array substrate includes a plurality of pixel electrodes and a plurality of thin-film transistors (TFTs) electrically connected to the pixel electrodes. The color filter substrate faces the array substrate, and has a common electrode and a plurality of color filters. The liquid crystal layer is interposed between the array substrate and the color filter substrate. When an electric field generated between the pixel electrode and the common electrode is applied to the liquid crystal layer, the arrangement direction of the liquid crystal molecules of the liquid crystal layer is altered to change the light transmittance of the liquid crystal layer, so that an image is displayed. The LCD panel displays a white image of a high luminance when the light transmittance is increased to a maximum value, and the LCD panel displays a black image of a low luminance when the light transmittance is decreased to a minimum value.

In a local dimming method, driving blocks of a backlight assembly are individually controlled according to the gray scale values of the image displayed on the LCD panel. When the backlight assembly includes a lamp module, the backlight assembly may use a one-dimensional local dimming method according to a lamp shape.

In the one-dimensional local dimming method, the backlight assembly is divided into a plurality of light source blocks, and the light source blocks are individually driven according to gray scale values of the image displayed on the LCD panel corresponding to the light source blocks.

However, when a white image is displayed outside of a light source block, the amount of luminance may be insufficient in a boundary area of the light source block adjacent to the light source block. Further, continuous frame images may cause flickering in the boundary areas of the light source blocks.

Thus, there is a need for methods and apparatuses that can increase the luminance and reduce the flickering in the boundary areas.

SUMMARY OF THE INVENTION

According to an exemplary embodiment of the present invention, a method of driving a light source includes: determining a location of pixel data of a display relative to a plurality of light-emitting blocks of a light source, obtaining a plurality of luminance values of the light-emitting blocks corresponding to the location by using a lookup table (LUT) storing the luminance values of the light-emitting blocks, generating a plurality of histograms corresponding to the light-emitting blocks, determining a plurality of target luminance values of the light-emitting blocks by using the histograms, and driving the light-emitting blocks by using the determined target luminance values. The luminance values of the light-emitting blocks are based on the location of the pixel data within an image block of the display corresponding to each light-emitting block. Each of the histograms indicates a frequency of each of the luminance values of a respective one of the light-emitting blocks.

According to an exemplary embodiment of the present invention, a light source apparatus includes a light source module, a location analyzing part, a lookup table (LUT), a target luminance determining part and a driving signal generating part. The light source module includes a plurality of light-emitting blocks. The location analyzing part determines a location of pixel data of a display relative to the light-emitting blocks. The LUT includes an address allocated corresponding to a relative location of the pixel data located within an image block corresponding to the light-emitting block. The address has a luminance value of a self light-emitting block corresponding to the image block including the pixel data and a luminance value of at least one peripheral light-emitting block disposed adjacent to the self light-emitting block. The target luminance determining part determines a plurality of target luminance values corresponding to the light-emitting blocks according to the location of the pixel data by using the LUT. The driving signal generating part generates a plurality of driving signals driving the light-emitting blocks by using the determined target luminance values.

According to an exemplary embodiment of the present invention, a display apparatus includes a display panel, a light source module, a location analyzing part, a lookup table (LUT), a target luminance determining part and a driving signal generating part. The display panel is configured to display an image. The light source module includes a plurality of light-emitting blocks. The location analyzing part determines a location of pixel data of a display relative to the light-emitting blocks. The LUT includes an address allocated corresponding to a relative location of the pixel data located within an image block corresponding to the light-emitting block. The address has a luminance value of a self light-emitting block corresponding to the image block including the pixel data and a luminance value of at least one peripheral light-emitting block disposed adjacent to the self light-emitting block. The target luminance determining part determines a plurality of target luminance values corresponding to the light-emitting blocks according to the location of the pixel data by using the LUT. The driving signal generating part generates a plurality of driving signals driving the light-emitting blocks by using the determined target luminance values.

BRIEF DESCRIPTION OF THE DRAWINGS

The present invention will become more apparent by describing in detail exemplary embodiments thereof with reference to the accompanying drawings, in which:

FIG. 8 is a schematic diagram illustrating an exemplary embodiment of the luminance LUT of FIG. 7; and FIG. 9 is schematic diagram illustrating an exemplary embodiment of a self light-emitting block and a peripheral light-emitting block corresponding to the luminance LUT of FIG. 8.

DETAILED DESCRIPTION OF EXEMPLARY EMBODIMENTS

The present invention is described more fully hereinafter with reference to the accompanying drawings, in which exemplary embodiments of the present invention are shown. The present invention may, however, be embodied in many different forms and should not be construed as limited to the exemplary embodiments set forth herein. It will be understood that when an element or layer is referred to as being "on," "connected to" or "coupled to" another element or layer, it can be directly on, connected or coupled to the other element or layer or intervening elements or layers may be present.

Hereinafter, exemplary embodiments of the present invention will be explained in more detail with reference to the accompanying drawings.

Figure 1:
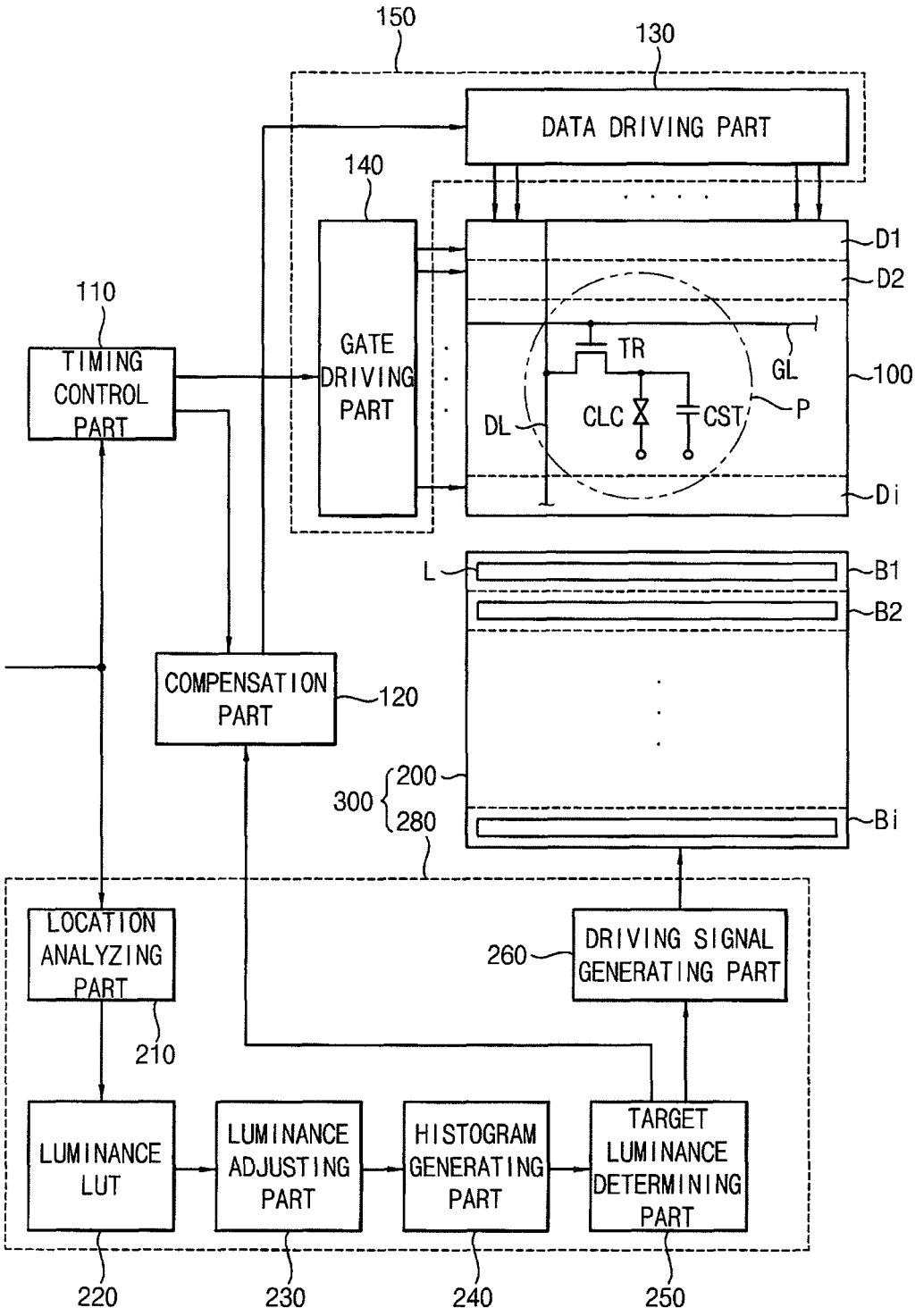
FIG. 1 is a block diagram illustrating a display apparatus according to an exemplary embodiment of the present invention.

FIG. 1 is a block diagram illustrating a display apparatus according to an exemplary embodiment of the present invention. Referring to FIG. 1, the display apparatus includes a display panel 100, a timing control part 110, a compensation part 120, a panel driving part 150 and a light source apparatus 300.

The display panel 100 includes a plurality of data lines DL, a plurality of gate lines GL and a plurality of pixels P. For example, the pixels may be arranged in a M×N matrix, where M and N are natural numbers. For example, the number of the data lines DL may be M, and the number of the gate lines GL may be N. Each pixel P includes a switching element TR connected to the gate line GL and the data line DL, and a liquid crystal capacitor CLC and a storage capacitor CST that are connected to the switching element TR.

The timing control part 110 receives a control signal and an image signal from an external source. The timing control part 110 generates a timing control signal which controls a driving timing of the display panel 100 by using the control signal. The timing control signal includes a clock signal, a horizontal start signal and a vertical start signal.

The compensation part 120 compensates one of the pixel data by using a plurality of target luminance values received from the light source apparatus 300. Each of the values respectively corresponds to a plurality of light-emitting blocks. A frame of an image displayed by the display panel 100 may be divided into a plurality of image blocks D1, . . . , Di. Each of the image blocks respectively corresponds to one of the light-emitting blocks. The pixel data included in each of the image blocks may be compensated using the target luminance values of each of the light-emitting blocks, which correspond to each of the image blocks. The compensation part 120 provides the panel driving part 150 with the compensated pixel data.

The panel driving part 150 includes a data driving part 130 and a gate driving part 140. The data driving part 130 drives the data lines DL by using a data control signal and an image signal received from the timing control part 110. The data driving part 130 converts the image signal into an analog type data signal for output to the data lines DL. The gate driving part 140 drives the gate lines GL by using a gate control signal received from the timing control part 110. The gate driving part 140 outputs a gate signal to the gate lines GL.

The light source apparatus 300 includes a light source module 200 and a light source driving part 280. The light source module 200 is divided into a plurality of light-emitting blocks B1, . . . , Bi, and the light-emitting blocks B1, . . . , Bi have a one-dimensional arrangement. Each of the light-emitting blocks includes at least one lamp L.

The light source driving part 280 includes a location analyzing part 210, a luminance lookup table (LUT) 220, a target luminance adjusting part 230, a histogram generating part 240, a target luminance determining part 250 and a driving signal generating part 260.

The location analyzing part 210 receives one of the pixel data, and analyzes its pixel location. The location analyzing part 210 determines a light-emitting block within the light-source module 200 that corresponds to the pixel location and determines a light-emitting block location within the light-emitting block that corresponds to the pixel location.

For example, when the frame of the image comprises 1920×1080 pixel data and the light source module 200 includes 8 light-emitting blocks, an image block corresponding to each of the light-emitting blocks includes 135 (=1080/8) pixel lines. In this example, the location analyzing part 210 analyzes the location of one of the pixel data that is located in a q-th pixel line within a k-th image block corresponding to a k-th light-emitting block. For example, "k" is $1 \le k \le 8$ and "q" is $1 \le q \le 135$.

The luminance LUT 220 includes an address corresponding to the location of the pixel line having one of the pixel data. Luminance values of a self light-emitting block corresponding to one of the pixel data and a peripheral light-emitting block adjacent to the self light-emitting block are stored at the address. The luminance values may be calculated in advance according to the location of the pixel line having one of the pixel data.

For example, when the light-emitting block comprises 135 pixel lines and the light source module 200 comprises 8 light-emitting blocks including the self light-emitting block, the luminance LUT 220 includes 135 addresses and each of the addresses stores 8 luminance values. When the location of the pixel line is received by the luminance LUT 220, the luminance values of the self light-emitting block and the peripheral light-emitting block stored in the address corresponding to the location of the pixel line are outputted. The luminance value stored in the luminance LUT 220 may correspond to a maximum gray scale value of all gray scale values of the pixel data. For example, when the pixel data is 8 bits (the gray scale values may range from 0 to 255), the luminance values stored in the luminance LUT 220 may correspond to a 255 gray scale value. Alternatively, the luminance values stored in the luminance LUT 220 may correspond to a middle gray scale value of all of the gray scale values.

The luminance adjusting part 230 adjusts levels of the luminance values provided from the luminance LUT 220 based on the gray scale value of the pixel data. For example, when the gray scale value of one of the pixel data is 127, the luminance adjusting part 230 may decrease levels of the luminance values from the gray scale value of 255 to the gray scale value of 127.

The histogram generating part 240 generates a plurality of histograms respectively corresponding to the light-emitting blocks B1, . . . , Bi. The luminance values adjusted by the luminance adjusting part 230 are stored in the histograms based on the location of the light-emitting block corresponding to one of the pixel data analyzed by the location analyzing part 210, so that the histogram generating part 240 generates the histograms respectively corresponding to the light-emitting blocks B1, . . . , Bi. For example, when one of the pixel data is located in a fourth light-emitting block between first to eighth light-emitting blocks, the luminance LUT 220 outputs the luminance value of the fourth light-emitting block, the luminance values of the first to third light-emitting blocks disposed above the fourth light-emitting block and the luminance values of the fifth to eighth light-emitting blocks disposed below the fourth light-emitting block. The luminance adjusting part 230 adjusts levels of the luminance values provided from the luminance LUT 220. The histogram generating part 240 generates first to eighth histograms by using the received luminance values of the first to eighth light-emitting blocks.

The target luminance determining part 250 determines a plurality of target luminance values respectively corresponding to the light-emitting blocks B1, . . . , Bi by using the histograms generated from the histogram generating part 240. For example, a maximum luminance value in a histogram may be selected as a target luminance value of a light-emitting block, or a predetermined luminance value lower than the maximum luminance value may be selected as the target luminance value of the light-emitting block.

The driving signal generating part 260 generates driving signals for driving the light-emitting blocks B1, . . . , Bi by using the target luminance values of the light-emitting blocks B1, . . . , Bi determined from the target luminance determining part 250.

As described above, the target luminance values of the self and peripheral light-emitting blocks are determined according to the location of one of the received pixel data. Therefore, image artifacts such as flickering that may occur when a white image passes through a boundary area between the light-emitting blocks may be prevented or reduced.

Figure 2A:
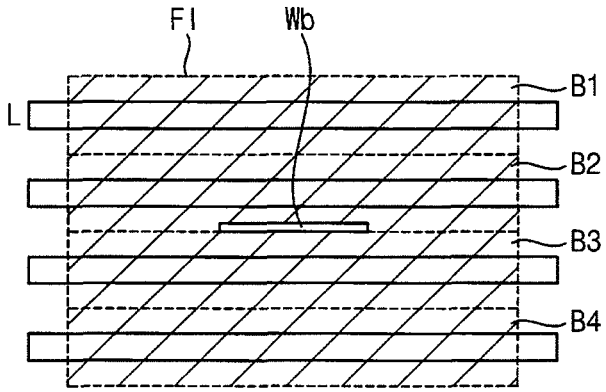
FIGS. 2A to 2C are schematic diagrams illustrating a method for generating a luminance lookup table (LUT) of FIG. 1 according to an exemplary embodiment of the present invention.
Figure 2B:
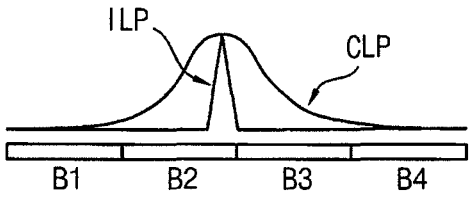
Figure 2C:
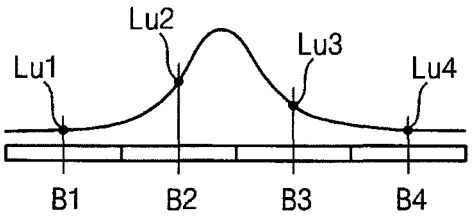

FIGS. 2A to 2C are schematic diagrams illustrating a method for generating the luminance LUT of FIG. 1 according to an exemplary embodiment of the present invention. Referring to FIG. 2A, a light source module includes first to fourth light-emitting blocks B1, B2, B3 and B4. For example, each of the light-emitting blocks includes a single lamp L. The first to fourth light-emitting blocks B1, B2, B3 and B4 provides a frame image FI including first to fourth image blocks with light.

The frame image FI includes a white box image Wb having a high gray scale value with a background image having a low gray scale value. The white box image Wb is located in the boundary area between the second and third light-emitting blocks B2 and B3.

FIG. 2B illustrates an ideal light profile ILP corresponding to the frame image FI shown in FIG. 2A. FIG. 2B further illustrates a light profile CLP that is calculated based on the ideal light profile ILP corresponding to the frame image FI shown in FIG. 2A.

Referring to FIGS. 2B and 2C, the ideal light profile ILP has a high luminance corresponding to the white box image Wb in the boundary area between the second and third light-emitting blocks B2 and B3, and a low luminance corresponding to the background image in a remaining area outside the boundary area. Duty ratios of the lamps respectively corresponding to the light-emitting blocks B1, B2, B3 and B4 may be calculated using various iteration methods. For example, the duty ratios may be calculated via a computer simulation to satisfy the ideal light profile ILP. For example, duty ratios satisfying the ideal light profile ILP may be obtained while the duty ratios change. A summation of the duty ratios satisfying the ideal light profile ILP may optimally decrease power consumption. As described above, the calculated light profile CLP may be obtained. The response time of the calculated light profile CLP is slower than the ideal light profile ILP.

When the calculated light profile CLP is obtained, middle luminance values Lu1, Lu2, Lu3 and Lu4 of the light-emitting blocks B1, B2, B3 and B4 are extracted using the calculated light profile CLP. The extracted middle luminance values Lu1, Lu2, Lu3 and Lu4 are respectively the luminance values of the light-emitting blocks B1, B2, B3 and B4. When the white box image Wb is located within the second light-emitting block adjacent to the boundary area between the second and third light-emitting blocks B2 and B3, the middle luminance values Lu1, Lu2, Lu3 and Lu4 are respectively the luminance values of the light-emitting blocks B1, B2, B3 and B4.

As described above, the luminance values of the first to fourth light-emitting blocks B1, B2, B3 and B4 are obtained according to the location of the white box image Wb while the location of the white box image Wb is changed. The luminance values are stored in the luminance LUT 220 as shown in FIG. 1.

Figure 3:
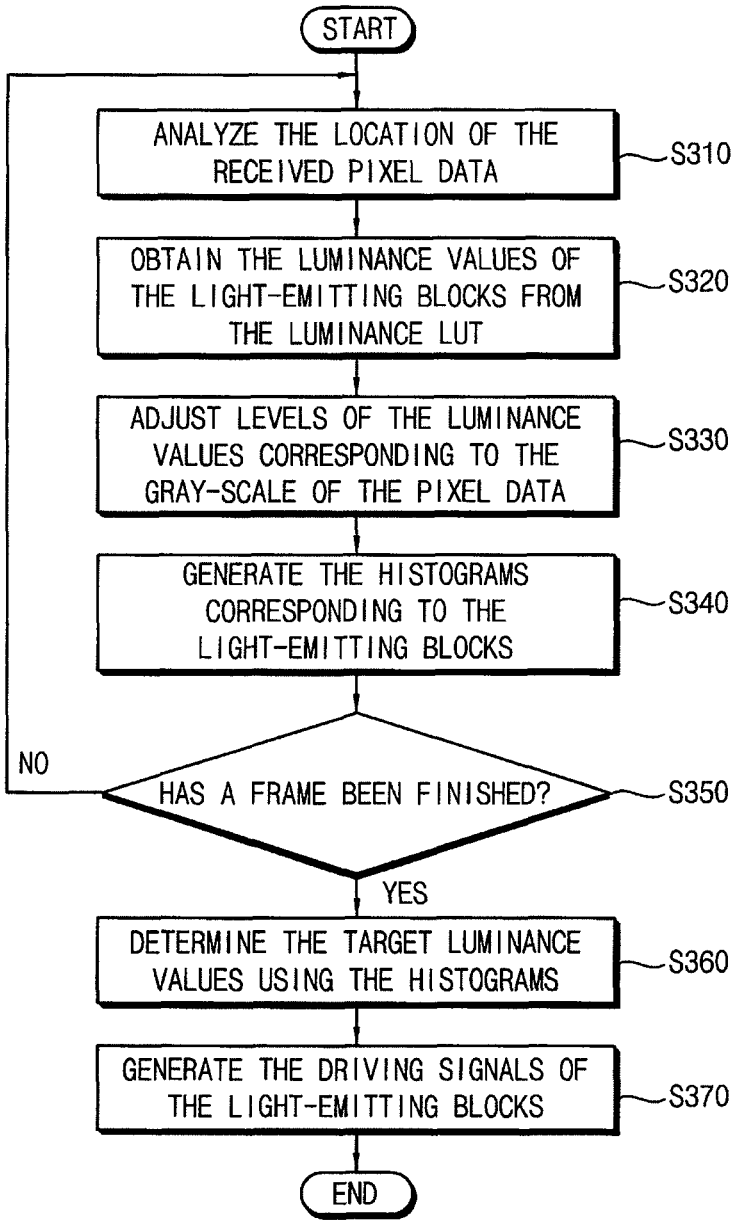
FIG. 3 is a flowchart illustrating a method for driving the light source apparatus of FIG. 1 according to an exemplary embodiment of the present invention.

FIG. 3 is a flowchart illustrating a method for driving the light source apparatus of FIG. 1 according to an exemplary embodiment of the present invention. Referring to FIGS. 1 and 3, the location analyzing part 210 analyzes the location of one of the received pixel data (step S310). For example, the location analyzing part 210 analyzes whether one of the pixel data is disposed in a location corresponding to a k-th light-emitting block and a relative location within the k-th light-emitting block such as a q-th pixel line. The location of the 'kth' light-emitting block is used in the histograms generated in the histogram generating part 240. The relative location of the 'qth' pixel line is used as the address of the luminance LUT 220 mentioned below.

The luminance values of the light-emitting blocks are obtained by the relative location, which is the address of the luminance LUT 220 (step S320). The luminance values include the luminance value of the self light-emitting block corresponding to the location of one of the pixel data and the luminance value of the peripheral light-emitting block adjacent to the self light-emitting block.

The luminance adjusting part 230 adjusts levels of the luminance values obtained from the luminance LUT 220 corresponding to the gray scale value of one of the received pixel data (step S330). For example, when the luminance values stored in the luminance LUT 220 correspond to a '255 ' gray scale value (e.g., when one of the pixel data is 8 bits), and one of the received pixel data is a '128 ' gray scale value, the luminance adjusting part 230 decreases levels of the luminance values obtained from the luminance LUT 220 to ½ of the levels of the luminance values, respectively.

The histogram generating part 240 receives the luminance values having the levels adjusted by the luminance adjusting part 230 to generate the histograms respectively corresponding to the light-emitting blocks B1, . . . , Bi (step S340).

The steps S310 to 5340 may be repeated for multiple pixel data during a single frame (step S350). The histogram generating part 240 generates the histograms respectively corresponding to the light-emitting blocks B1, . . . , Bi by a unit of the single frame. Each of the histograms may indicate a frequency number related to the luminance value.

The target luminance determining part 250 determines the target luminance values respectively corresponding to the light-emitting blocks B1, . . . , Bi by using the histograms of the light-emitting blocks B1, . . . , Bi (step S360). For example, a maximum luminance value in a histogram may be selected as the target luminance value of the light-emitting block, or a predetermined luminance value lower than the maximum luminance value may be selected as the target luminance value of the light-emitting block.

The driving signal generating part 260 generates driving signals for driving the light-emitting blocks B1, . . . , Bi by using the determined target luminance values (step S370). The driving signals are provided to the light-emitting blocks B1, . . . , Bi, respectively, so that the light-emitting blocks B1, . . . , Bi may have an adaptive luminance by considering the location of one of the pixel data.

Figures 4, 5A:
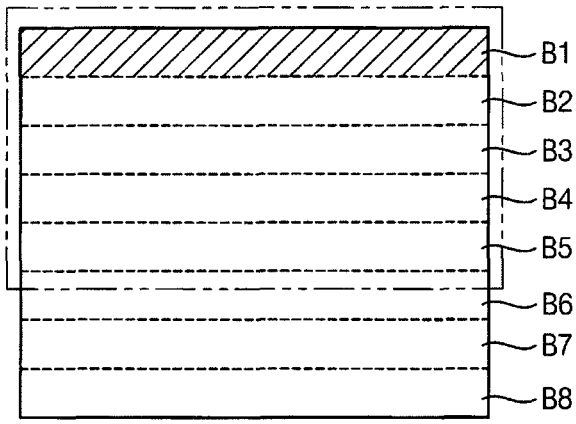
FIG. 4 is a schematic diagram illustrating an exemplary embodiment of the luminance LUT of FIG. 1.
FIGS. 5A and 5B are schematic diagrams illustrating exemplary embodiments of a self light-emitting block and a peripheral light-emitting block corresponding to the luminance LUT of FIG. 4.
Figure 5B:
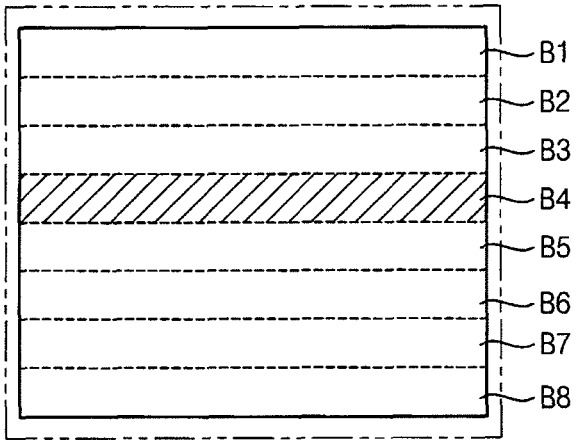
Figure 6:
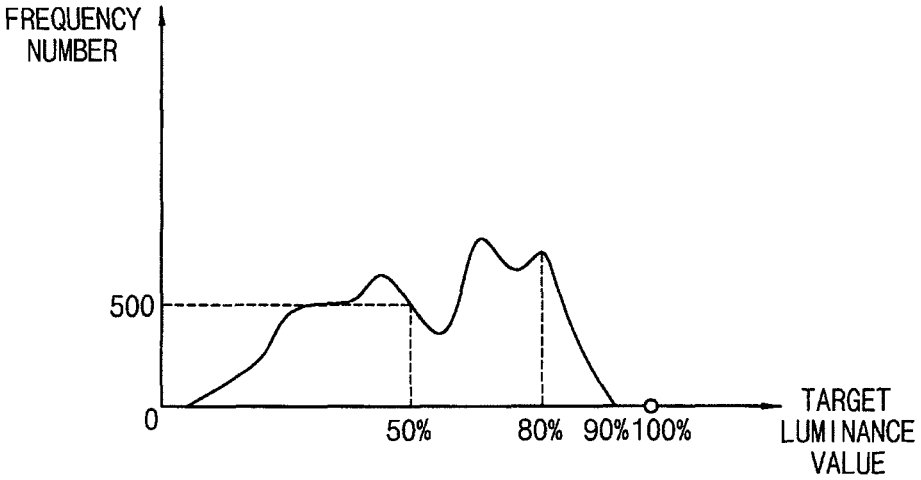
FIG. 6 is a graph showing an exemplary histogram generated from the histogram generating part of FIG. 1.

FIG. 4 is a schematic diagram illustrating an exemplary embodiment of the luminance LUT of FIG. 1. FIGS. 5A and 5B are schematic diagrams illustrating an exemplary embodiment of a self light-emitting block and a peripheral light-emitting block corresponding to the luminance LUT of FIG. 4. FIG. 6 is a graph showing an exemplary histogram generated from the histogram generating part of FIG. 1.

As discussed above, when a frame image includes 1920×1080 pixel data and the light source module 200 includes 8 light-emitting blocks, an image block corresponding to each of the light-emitting blocks includes 135 (=1080/8) pixel lines. In this example, the luminance LUT 220 has first to 135th addresses as shown in FIG. 4, and each of the addresses stores first to eighth luminance values (8×10 bits). A fourth luminance value of the first to eighth luminance values is a luminance value of the self light-emitting block that provides an image block including one of the pixel data with the light. The first to third luminance values and the fifth to eighth luminance values are the luminance values of the peripheral light-emitting blocks adjacent to the self light-emitting block.

Referring to FIGS. 1 and 5A, when one of the pixel data is located in a first pixel line within an image block corresponding to a first light-emitting block B1, first to eighth luminance values stored in a "first" address (1st address) are read from the luminance LUT 220 based on the location "first" of the pixel line. The fourth luminance value of the first to eighth luminance values is the luminance value of the first light-emitting block B1. A peripheral light-emitting block is not present above the first light-emitting block B1 so that the first to third luminance values read from the luminance LUT 220 may be disregarded. The peripheral light-emitting blocks disposed below the first light-emitting block B1 are second to fifth light-emitting blocks B2, B3, B4 and B5, so that the luminance values of the second to fifth light-emitting blocks B2, B3, B4 and B5 may respectively be the fifth to eighth luminance values.

The luminance adjusting part 230 adjusts levels of the fourth to eighth luminance values corresponding to the gray scale value of one of the pixel data, and the histogram generating part 240 receives the adjusted fourth to eighth luminance values.

For example, when the frame image includes 1920×1080 pixel data, one pixel line includes 1920 pixel data. Therefore, when a first pixel data of a predetermined pixel line is received, the first to eighth luminance values are read from the luminance LUT 220. When the remaining 1919 pixel data are received, the read first to eighth luminance values may repeatedly used.

Referring to FIGS. 1 and 5B, when one of the pixel data is located in 135th pixel line within an image block corresponding to a fourth light-emitting block B4, first to eighth luminance values stored in "135th" address (135th address) are read from the luminance LUT 220 based on the location "135" of the pixel line. The fourth luminance value of the first to eighth luminance values is the luminance value of the fourth light-emitting block B4. Peripheral light-emitting blocks disposed above the fourth light-emitting block B4 are respectively the first to third light-emitting blocks B1, B2 and B3, so that the luminance values of the first to third light-emitting blocks B1, B2 and B3 are respectively the first to third luminance values. Peripheral light-emitting blocks disposed below the fourth light-emitting block B4 are respectively the fifth to eighth light-emitting blocks B5, B6, B7 and B8, so that the luminance values of the fifth to eighth light-emitting blocks B5, B6, B7 and B8 are respectively the fifth to eighth luminance values.

The luminance adjusting part 230 adjusts the levels of the first to eighth luminance values corresponding to the gray scale value of one of the pixel data, and the histogram generating part 240 receives the adjusted first to eighth luminance values.

As described above, the first to eighth luminance values of the first to eighth light-emitting blocks B1, . . . , B8 are obtained by using the first pixel data to last pixel data of the frame image, and the histograms respectively corresponding to the first to eighth light-emitting blocks B1, . . . , B8 are generated by using the luminance values obtained according to the location of one of the pixel data.

Referring to FIGS. 1 and 6, each of the histograms may express a frequency number with respect to the luminance value. For example, when the luminance value is about 50%, the frequency number is about 500 as shown in FIG. 6. The histogram generating part 240 generates first to eighth histograms respectively corresponding to the first to eighth light-emitting blocks B1, . . . , B8. The target luminance determining part 250 analyzes the first to eighth histograms to determine the target luminance values of the first to eighth light-emitting blocks B1, . . . , B8. The target luminance value of the light-emitting block may be determined as a maximum luminance value (for example, 90%) or as the predetermined luminance value (for example, 80%) lower than the maximum luminance value.

Figure 7:
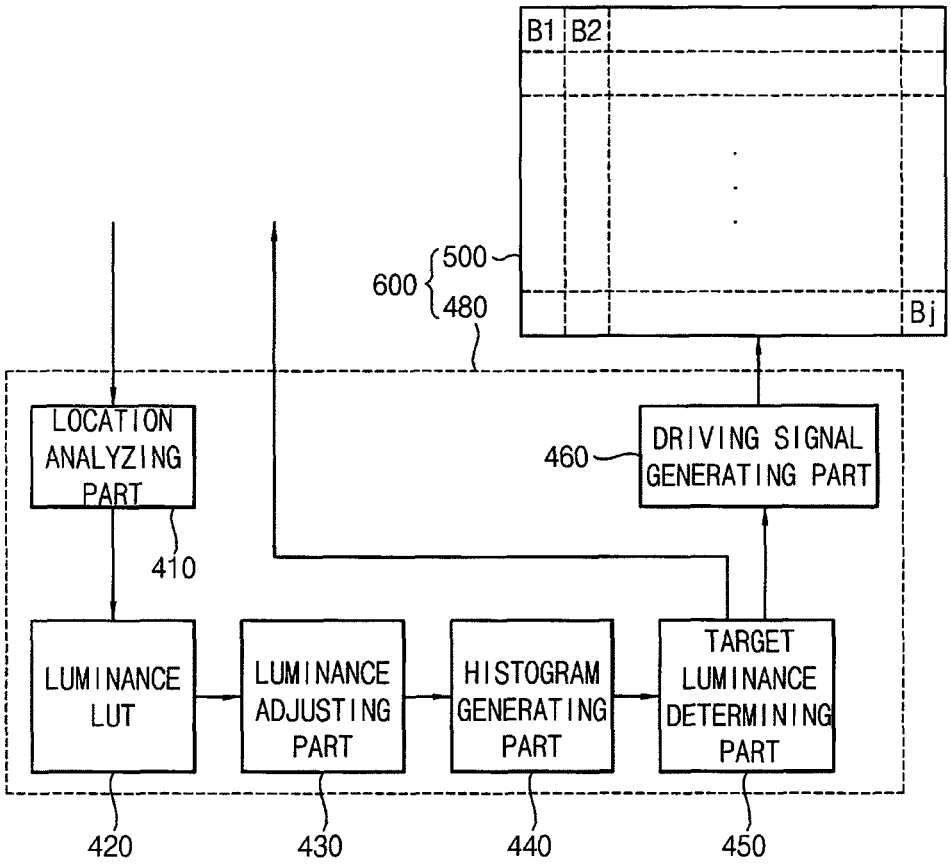
FIG. 7 is a block diagram illustrating a light source apparatus according to an exemplary embodiment of the present invention.

FIG. 7 is a block diagram illustrating a light source apparatus according to an exemplary embodiment of the present invention. FIG. 8 is a schematic diagram illustrating an exemplary embodiment of the luminance LUT of FIG. 7.

Referring to FIG. 7, the light source apparatus 600 includes a light source module 500 and a light source driving part 480 for driving the light source module 500. The light source driving part 480 is substantially the same as the light source driving part 280 of FIG. 1.

The light source module 500 is divided into a plurality of light-emitting blocks B1, B2, . . . , Bj, and each of the light-emitting blocks have a two-dimensional arrangement. Each of the light-emitting blocks includes at least one light-emitting diode (LED).

The light source driving part 480 includes a location analyzing part 410, a luminance LUT 420, a luminance adjusting part 430, a histogram generating part 440, a target luminance determining part 450 and a driving signal generating part 460.

The location analyzing part 410 receives one of the pixel data, and analyzes a location of the received pixel data. The location analyzing part 410 determines which light-emitting block of the light-emitting blocks B1, . . . , Bj corresponds to the pixel data and the relative location of the light-emitting block in the light-emitting blocks B1, . . . , Bj, with respect to the frame image.

For example, assume a frame image includes 1920×1080 pixel data, the light source module 500 includes 8×8 light-emitting blocks, and an image block corresponding to each of the light-emitting blocks includes 135×120 pixel data. In this example, the location analyzing part 410 analyzes the location of one of the pixel data that is located in a q-th pixel data within a k-th image block corresponding to a k-th light-emitting block, where "k" is $1 \leq k \leq (8 \times 8)$ and "q" is $1 \leq q \leq (135 \times 120)$.

The luminance LUT 420 includes an address corresponding to the location of the pixel line including one of the pixel data, and luminance values of a self light-emitting block corresponding to one of the pixel data and a peripheral light-emitting block adjacent to the self light-emitting block are stored at the address. The luminance values may be calculated in advance according to the location that includes one of the pixel data. The luminance LUT 420 may be obtained using various iteration methods via a computer simulation as described in FIGS. 2A to 2C.

Referring to FIG. 8, the luminance LUT 420 has 135×120 addresses, and 9 luminance values are stored at each of the addresses. The 9 luminance values include a luminance value of a self light-emitting block corresponding to an image block including one of the pixel data and luminance values of peripheral light-emitting blocks adjacent to the self light-emitting block. The number of the luminance values stored at the address may be decreased, or the number of the addresses may be decreased to reduce the size of the LUT 420. Gray scale values of pixel data adjacent to each other may be substantially the same as each other, so that the number of the addresses may be decreased, for example, from 135×120 to 67×120.

The luminance adjusting part 430 adjusts levels of the luminance values read from the luminance LUT 420 based on a gray scale value of one of the pixel data.

The histogram generating part 440 generates a plurality of histograms respectively corresponding to the light-emitting blocks B1, . . . , Bj. The histogram generating part 440 generates the histograms by using the luminance values adjusted via the luminance adjusting part 430.

The target luminance determining part 450 determines a plurality of target luminance values respectively corresponding to the light-emitting blocks B1, . . . , Bj based on the histograms of the light-emitting blocks B1, . . . , Bj, which are generated from the histogram generating part 440. For example, the target luminance value may be determined as a maximum luminance value in a histogram, or as a predeteiniined luminance value lower than the maximum luminance value.

The driving signal generating part 460 generates a plurality of driving signals driving the light-emitting blocks B1, . . . , Bj by using the target luminance values determined via the target luminance determining part 450.

As described above, the target luminance values of the self and peripheral light-emitting blocks may be determined according to the location of one of the received pixel data, so that image artifacts such as flickering that may occur when a white image passes through a boundary of the light-emitting blocks due to a change of the luminance may be reduced or prevented.

FIG. 9 is schematic diagram illustrating an exemplary self light-emitting block and a peripheral light-emitting block corresponding to the luminance LUT of FIG. 8. Referring to FIGS. 8 and 9, the luminance LUT 420 has 135×120 addresses, and first to ninth luminance values are stored at each of the addresses. A fifth luminance value among the first to ninth luminance values is a luminance value of a self light-emitting block corresponding to one of the received pixel data. The first to fourth luminance values and the sixth to ninth luminance values are luminance values of peripheral light-emitting blocks disposed in a peripheral area of the self light-emitting block.

For example, when one of the pixel data is located in a fifth pixel within a 19th light-emitting block B19, the luminance LUT 420 reads first to ninth luminance values stored in a fifth address corresponding to the location of one of the pixel data. The fifth luminance value of the first to ninth luminance values is the luminance value of the 19th light-emitting block B19. The first to fourth luminance values are luminance values of 10th, 11th, 12th and 18th light-emitting blocks B10, B11, B12 and B that are the peripheral light-emitting blocks disposed at left and upper sides of the 19th light-emitting block B19, respectively. The sixth to ninth luminance values are luminance values of 20th, 26th, 27th and 28th light-emitting blocks B20, B26, B27 and B28 that are the peripheral light-emitting blocks disposed at right and lower sides of the 19th light-emitting block B19, respectively. Then, the first to ninth luminance values respectively corresponding to the 10th, 11th, 12th, 18th, 19th, 20th, 26th, 27th and 28th light-emitting blocks B10, B11, B12, B18, B20, B26, B27 and B28 are adjusted via luminance adjusting part 430 and received by the histogram generating part 440.

Alternatively, when one of the pixel data is located in a 10th pixel within a 64th light-emitting block B64, the luminance LUT 420 reads first to ninth luminance values stored in a 10th address corresponding to the location of one of the pixel data. The fifth luminance value of the first to ninth luminance values is the luminance value of the 64th light-emitting block B64. The first to fourth luminance values are luminance values of the peripheral light-emitting blocks disposed at left and upper sides of the 64th light-emitting block B64. Then, the first luminance value is a luminance value of 55th light-emitting block B55, the second luminance value is a luminance value of 56th light-emitting block B56 and the fourth luminance value is a luminance value of 63rd light-emitting block B63. Peripheral light-emitting blocks respectively corresponding to third, sixth, seventh, eighth and ninth luminance values are not present so that third, sixth, seventh, eighth and ninth luminance values read from the luminance LUT 220 may be disregarded hereinafter. Then, levels of the first to ninth luminance values respectively corresponding to the 55th, 56th, 63rd and 64th light-emitting blocks B55, B56, B63 and B64 are adjusted via luminance adjusting part 430 and received by the histogram generating part 440.

The target luminance determining part 450 determines the target luminance values of the first to 64th light-emitting blocks B1, . . . , B64 based on first to 64th histograms respectively corresponding to the first to 64th light-emitting blocks B1, . . . , B64. For example, the target luminance value may be determined as a maximum luminance value in a histogram, or as a predetermined luminance value lower than the maximum luminance value.

A method of driving the light source module 500 according to the present exemplary embodiment is substantially the same as the method of driving the light source module 200 described in FIG. 3.

According to at least one embodiment of the present invention, target luminance values for driving light-emitting blocks may be determined by using a luminance LUT storing luminance values that are changed according to a location of one of the pixel data, so that display quality may be improved. Further, calculations for obtaining the luminance values may be performed in advance and stored to generate the luminance LUT. Therefore, the size of a logic circuit for driving a light source may be decreased.

Although exemplary embodiments of the present invention have been described, those skilled in the art will readily appreciate that various modifications can be made without departing from the spirit and scope of the present invention. Accordingly, all such modifications are intended to be included within the scope of the present disclosure.

What is claimed is:

1. A method for driving a light source, the method comprising:

determining which one of the light-emitting blocks the pixel data corresponds to, the one light-emitting block corresponding to an image block of the display comprising a plurality of lines;

determining which one of the lines of the image block the pixel data corresponds to;

referring to a lookup table (LUT) comprising an address for each line and an entry for each address, the entry including a plurality of luminance values of the light-emitting blocks;

obtaining the luminance values of the light-emitting blocks by using the entry of the LUT corresponding to the determined one line;

generating a plurality of histograms corresponding to the light-emitting blocks, each of the histograms indicating a frequency of each of the luminance values of a respective one of the light-emitting blocks;

determining a plurality of target luminance values of the light-emitting blocks by using the histograms of the light-emitting blocks; and driving the light-emitting blocks by using the determined target luminance values.

2. The method of claim 1, wherein the entry includes a luminance value of a self light-emitting block corresponding to the image block including the pixel data and a luminance value of at least one peripheral light-emitting block disposed adjacent to the self light-emitting block.

3. The method of claim 1, wherein the luminance values stored in the LUT correspond to a maximum gray scale value of an entire gray scale range of the pixel data.

4. The method of claim 3, further comprising: adjusting levels of the luminance values obtained from the LUT according to a gray scale value of the pixel data.

5. The method of claim 1, wherein the light-emitting blocks are disposed in a one-dimensional arrangement.

6. The method of claim 1, wherein the light-emitting blocks are disposed in a two-dimensional arrangement.

7. A light source apparatus comprising:

a light source module including a plurality of light-emitting blocks;

an analyzing part analyzing pixel data of a display to determine which one of the light-emitting blocks the pixel data corresponds to, the one light-emitting block corresponding to an image block of the display comprising a plurality of lines, the analyzing part further determining which one of the lines of the image block the pixel data corresponds to;

a lookup table (LUT) comprising an address for each line and an entry for each address, wherein the entry includes a luminance value of a self light-emitting block corresponding to the image block including the pixel data and a luminance value of at least one peripheral light-emitting block disposed adjacent to the self light-emitting block;

a target luminance determining part obtaining a plurality of target luminance values corresponding to the light-emitting blocks by using the entry of the LUT corresponding to the determined one line; and a driving signal generating part generating a plurality of driving signals driving the light-emitting blocks by using the determined target luminance values.

8. The light source apparatus of claim 7, further comprising: a histogram generating part generating a plurality of histograms corresponding to the light-emitting blocks, each of the histograms indicating a frequency of the luminance values of a respective one of the light-emitting blocks, wherein the target luminance determining part determines the target luminance values corresponding to the light-emitting blocks by using the histograms of the light-emitting blocks.

9. The light source apparatus of claim 7, wherein the luminance values stored in the LUT correspond to a maximum gray scale value of an entire gray scale range of the pixel data.

10. The light source apparatus of claim 9, further comprising: a luminance adjusting part adjusting levels of the target luminance values obtained from the LUT according to a gray scale value of the pixel data.

11. The light source apparatus of claim 7, wherein each of the light-emitting blocks includes at least one lamp.

12. The light source apparatus of claim 7, wherein each of the light-emitting blocks includes at least one light emitting diode (LED).

13. A display apparatus comprising:

a display panel configured to display an image;

a light source module includes a plurality of light-emitting blocks;

an analyzing part analyzing pixel data of a display to determine which one of the light-emitting blocks the pixel data corresponds to, the one light-emitting block corresponding to an image block of the display comprising a plurality of lines, the analyzing part further determining which one of the lines of the image block the pixel data corresponds to;

a lookup table (LUT) comprising an address for each line and an entry for each address, wherein the entry includes a luminance value of a self light-emitting block corresponding to the image block including the pixel data and a luminance value of at least one peripheral light-emitting block disposed adjacent to the self light-emitting block;

a target luminance determining part obtaining a plurality of target luminance values corresponding to the light-emitting blocks by using the entry of the LUT corresponding to the determined one line; and a driving signal generating part generating a plurality of driving signals driving the light-emitting blocks by using the determined target luminance values.

14. The display apparatus of claim 13, further comprising: a compensating part compensating the pixel data by using the target luminance values of the light-emitting blocks received from the target luminance determining part.

15. The display apparatus of claim 14, further comprising: a data driving part converting the compensated pixel data into an analog data voltage, to provide the display panel with the analog data voltage.

16. The display apparatus of claim 13, further comprising: a histogram generating part generating a plurality of histograms corresponding to the light-emitting blocks, each of the histograms indicating a frequency of the luminance values of a respective one of the light-emitting blocks, wherein the target luminance determining part determines the target luminance values corresponding to the light-emitting blocks by using the histograms of the light-emitting blocks.

17. The display apparatus of claim 13, wherein the luminance values stored in the LUT correspond to a maximum gray scale of an entire gray scale range of the pixel data.

18. The display apparatus of claim 17, further comprising: a luminance adjusting part adjusting the luminance values obtained from the LUT according to a gray scale value of the pixel data.

19. The display apparatus of claim 13, wherein each of the light-emitting blocks includes at least one lamp, and the light-emitting blocks are disposed in a one-dimensional arrangement.

20. The display apparatus of claim 13, wherein each of the light-emitting blocks includes at least one light emitting diode (LED), and the light-emitting blocks are disposed in a two-dimensional arrangement.

* * * * *